US007040550B2

(12) United States Patent
Hohl et al.

(10) Patent No.: US 7,040,550 B2
(45) Date of Patent: May 9, 2006

(54) FUEL INJECTION VALVE

(75) Inventors: Guenther Hohl, Stuttgart (DE); Michael Huebel, Gerlingen (DE); Juergen Stein, Illingen (DE)

(73) Assignee: Robert Bosch GmbH, Stuttgart (DE)

( * ) Notice: Subject to any disclaimer, the term of this patent is extended or adjusted under 35 U.S.C. 154(b) by 45 days.

(21) Appl. No.: 10/467,211

(22) PCT Filed: Nov. 25, 2002

(86) PCT No.: PCT/DE02/04312

§ 371 (c)(1),
(2), (4) Date: Jan. 14, 2004

(87) PCT Pub. No.: WO03/054377

PCT Pub. Date: Jul. 3, 2003

(65) Prior Publication Data

US 2004/0118950 A1 Jun. 24, 2004

(30) Foreign Application Priority Data

Dec. 5, 2001 (DE) ..... 101 59 749

(51) Int. Cl.
*B05B 1/08* (2006.01)

(52) U.S. Cl. ..... 239/102.2; 239/584; 239/533.8; 239/533.9; 251/57; 251/129.06

(58) Field of Classification Search ..... 239/102.2, 239/533.4, 533.8, 533.9, 584, 533.12; 251/57, 251/129.06
See application file for complete search history.

(56) References Cited

U.S. PATENT DOCUMENTS

| | | | |
|---|---|---|---|
| 6,062,532 A | 5/2000 | Gurich et al. | |
| 6,766,965 B1 * | 7/2004 | D'Arrigo | 239/102.2 |
| 2003/0116656 A1 | 6/2003 | Hohl | |

FOREIGN PATENT DOCUMENTS

| | | |
|---|---|---|
| DE | 297 08 546 | 9/1998 |
| DE | 199 50 760 | 4/2001 |
| DE | 199 54 537 | 5/2001 |
| DE | 199 58 704 | 6/2001 |
| DE | 199 62 177 | 7/2001 |
| DE | 199 63 568 | 7/2001 |
| EP | 0477400 | 1/1992 |
| EP | 1046809 | 10/2000 |
| EP | 1079158 | 2/2001 |
| EP | 1111230 | 6/2001 |

* cited by examiner

*Primary Examiner*—Steven J. Ganey
(74) *Attorney, Agent, or Firm*—Kenyon & Kenyon LLP

(57) ABSTRACT

A fuel injector for the direct injection of fuel into the combustion chamber of an internal combustion engine includes a piezoelectric or magnetostrictive actuator, a hydraulic coupler, the hydraulic coupler having a master piston and a slave piston that are connected to a pressure chamber, and the pressure chamber being filled with an hydraulic fluid. The pressure chamber is sealed from an actuator chamber by a first seal and from a valve interior chamber by a second seal.

9 Claims, 1 Drawing Sheet

FUEL INJECTION VALVE

FIELD OF THE INVENTION

The present invention is directed to a fuel injector.

BACKGROUND INFORMATION

European Published Patent Application No. 0 477 400 describes a hydraulic coupler for a piezoelectric actuator in which the actuator transmits a lifting force to a master piston. The master piston is in force-locking connection to a guide cylinder for a slave piston. The slave piston, the guide cylinder and the master piston sealing the guide cylinder form an hydraulic chamber. A spring, which presses the master piston and the slave piston apart, is arranged in the hydraulic chamber. Surrounding an end section of the guide cylinder and the slave piston is a rubber sleeve by which a supply chamber for a viscous hydraulic fluid is sealed from a fuel chamber. The viscosity of the hydraulic fluid is adapted to the ring gap between the slave piston and the guide cylinder.

The slave piston may mechanically transmit a lifting movement to a valve needle, for instance. When the actuator transmits a lifting movement to the master piston and the guide cylinder, this lifting movement is transmitted to the slave piston by the pressure of the hydraulic fluid in the hydraulic chamber, because the hydraulic fluid in the hydraulic chamber is not compressible and during the short duration of a lift only a small portion of the hydraulic fluid is able to escape through the ring gap into the storage chamber formed by the rubber sleeve. In the rest phase, when the actuator does not exert any compressive force on the master piston, the spring pushes the slave piston out of the guide cylinder and, due to the generated vacuum pressure, the hydraulic fluid enters and refills the hydraulic chamber via the ring gap. In this manner, the coupler automatically adapts to linear deformations and pressure-related expansions of a fuel injector.

A disadvantage of conventional hydraulic couplers is that the sealing by a rubber sleeve, which usually is pressed against the end section of the guide cylinder and against the slave piston by two clamping rings, is not fully ensured in the long term. The highly viscous hydraulic fluid and the fuel may mix and the coupler break down. When fuel, such as gasoline, reaches the interior of the coupler, a loss of function may occur since this fluid, due to the low viscosity of the gasoline, may flow too rapidly through the ring gap and no pressure is able to be generated in the pressure chamber during the lift duration.

SUMMARY

A fuel injector according to an example embodiment of the present invention includes a pressure chamber that is sealed from an actuator chamber and a fuel chamber by a seal both on the master piston and the slave piston. This arrangement may provide completely sealing the coupler from penetrating fuel.

One example embodiment may provide a simple construction, which may not require the use of springs for acting on the master and slave pistons of the coupler. The seals have the form of a corrugated tube, so that they not only assume a sealing function, but also implement the return of the pistons.

The coupler may be encapsulated in a two-part coupler housing, so that the inflow-side corrugated-tube seal is not acted upon by fuel pressure. As a result, a thinner material may be selected for the seal, so that sufficient elasticity may be assured for the hydraulic-medium compensation. In addition, the coupler housing may allow a simple preassembly.

Furthermore, different diameters may be selected and thus different effective areas may be selected for the master piston and the slave piston. This makes it possible to step up the travel, and the small lift of the actuator is able to be translated into a larger stroke.

In another example embodiment, an actuator spring may be configured in the form of a helical spring between the actuator and the coupler housing, the actuator spring prestressing the actuator.

An exemplary embodiment of the present invention is illustrated in the drawing schematically and explained in greater detail in the following description.

DETAILED DESCRIPTION

Figure 1:
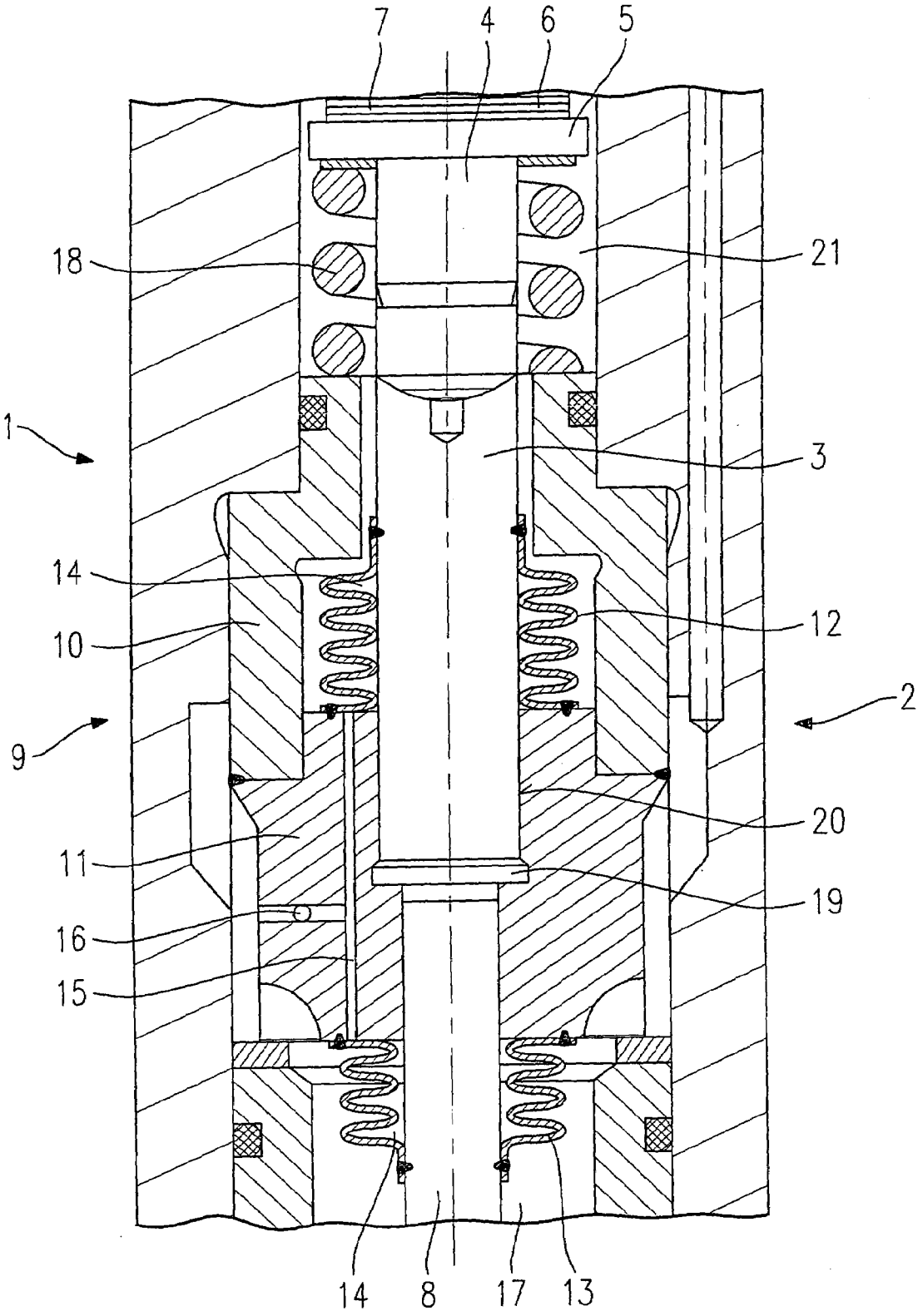
FIG. 1 is a schematic cross-sectional view through an example embodiment of a fuel injector configured according to the present invention in the region of the coupler.

FIG. 1 illustrates a schematic cut-away portion of a fuel injector 1, the region of an hydraulic coupler 2 being represented. Fuel injector 1 may be used, in particular, for the direct injection of fuel into a combustion chamber of a mixture-compressing internal combustion engine having externally supplied ignition.

Coupler 2 includes a master piston 3 on which an actuating member 4 is braced. On the inflow side, actuating member 4 widens to an actuator base 5 against which a piezoelectric or magnetostrictive actuator 6 abuts. Actuator 6 may be made up of a plurality of piezoelectric or magnetostrictive layers 7.

A slave piston 8 is arranged on the downstream side of master piston 3. Slave piston 8 and master piston 3 are encapsulated in a two-part coupler housing 9. A first part 10 and a second part 11 of coupler housing 9 are interconnected, for instance by welding. Via a first seal 12, which is in the form of a corrugated tube and welded to master piston 3, master piston 3 is joined to second part 11 of coupler housing 9, by welding as well, and seals coupler housing 9 from an actuator chamber 21 in which actuator 6 is arranged. A second seal 13, which is located on the downstream side of second part 11 of coupler housing 9 and welded thereto, may also be configured in the shape of a corrugated tube and joined to slave piston 8. Second seal 13 seals coupler housing 9 from a fuel chamber 17 acted upon by fuel. Master piston 3 and slave piston 8 may have different diameters or different effective end faces, so as to allow a translation of the actuator lift up to a ratio of 3:1.

A pressure chamber 14 is delimited by seals 12 and 13, second part 11 of coupler housing 9 and slave piston 8. Pressure chamber 14 may be filled with, e.g., a high-viscosity hydraulic medium. A highly viscous hydraulic medium has the advantage, among others, that the demands on the precision of the piston guidance are lower than in the case of a low-viscosity medium. Moreover, the lower steam pressure is able to reduce any cavitation tendency.

In second part 11 of coupler housing 9, a compensation bore 15 may be formed, which allows the hydraulic medium to flow freely around coupler 2 during slow movements of master piston 3, for instance because of temperature effects. Pressure chamber 14 may be filled with hydraulic medium via a filling valve 16.

Clamped between first part 10 of coupler housing 9 and actuator base 5 is an actuator spring 18, which is in the form of a helical spring and provides an initial stress to actuator 6.

By arranging first seal 12 between first part 10 of coupler housing 9, master piston 3 and second part 11 of coupler housing 9, it may be provided that the first seal is not acted upon by the pressure of the fuel flowing through fuel injector 1. As a result, the material of the seal may be selected to be thin and/or elastic so that the hydraulic medium may attain a sufficiently large displacement volume without escaping from pressure chamber 14.

If actuator 6 is supplied with an electrical excitation voltage via an electrical line, layers 7 of actuator 6 expand, thereby rapidly pressing actuator base 5 in the discharge direction. The rapid movement is transmitted to master piston 3 via actuating member 4. The hydraulic medium located in a coupler gap 19 transmits the movement to slave piston 8, hydraulic medium being displaced via ring gap 20. Slave piston 8 has a smaller effective area than master piston 3, so that the small lift of actuator 6 is translated into a larger actuator travel of a valve needle, for example, which may be in operative connection to slave piston 8. If the voltage energizing actuator 6 is switched off, actuator 6 contracts, thereby relieving master piston 3.

The present invention is not limited to the example embodiment shown and is also applicable, for instance, to fuel injectors for mixture-compressing, self-ignitable internal combustion engines.

What is claimed is:

1. A fuel injector configured to directly inject fuel into a combustion chamber of an internal combustion engine, comprising:

an actuator chamber;

a fuel chamber in which the fuel is situated;

one of a piezoelectric and a magnetostrictive actuator situated in the actuator chamber;

a pressure chamber filled with a hydraulic fluid;

a hydraulic coupler including a master piston and a slave piston connected to the pressure chamber;

a first seal;

a second seal; and a two-part coupler housing encapsulating the hydraulic coupler, wherein the pressure chamber is sealed from the actuator chamber via the first seal and is sealed from the fuel chamber via the second seal, and wherein a first part of the coupler housing is welded to a second part of the coupler housing.

2. The fuel injector as recited in claim 1, wherein the first seal and the second seal include corrugated-tube seals.

3. The fuel injector as recited in claim 1, wherein the first seal is configured as a restoring spring for the master piston.

4. The fuel injector as recited in claim 3, wherein the first seal is welded to the master piston.

5. The fuel injector as recited in claim 1, wherein the second seal is configured as a restoring spring for the slave piston.

6. The fuel injector as recited in claim 5, wherein the second seal is welded to the slave piston.

7. A fuel injector configured to directly inject fuel into a combustion chamber of an internal combustion engine, comprising:

an actuator chamber;

a fuel chamber in which the fuel is situated;

one of a piezoelectric and a magnetostrictive actuator situated in the actuator chamber;

a pressure chamber filled with a hydraulic fluid;

a hydraulic coupler including a master piston and a slave piston connected to the pressure chamber;

a first seal;

a second seal;

a two-part coupler housing encapsulating the hydraulic coupler;

an actuator base; and an actuator spring arranged in the actuator chamber between the coupler housing and the actuator base, the actuator spring configured to exert a prestressing force upon the actuator, wherein the pressure chamber is sealed from the actuator chamber via the first seal and is sealed from the fuel chamber via the second seal.

8. The fuel injector as recited in claim 7, wherein the actuator spring includes a coiled spring.

9. The fuel injector as recited in claim 1, wherein the hydraulic fluid includes silicon oil.

* * * * *